US007980013B2

(12) United States Patent
Hsu

(10) Patent No.: US 7,980,013 B2
(45) Date of Patent: Jul. 19, 2011

(54) POSTCARD

(75) Inventor: Yu-Tswan Hsu, Taipei County (TW)

(73) Assignee: Golden Image Art Company, Jhonghe (TW)

( * ) Notice: Subject to any disclaimer, the term of this patent is extended or adjusted under 35 U.S.C. 154(b) by 76 days.

(21) Appl. No.: 12/469,750

(22) Filed: May 21, 2009

(65) Prior Publication Data

US 2010/0293823 A1 Nov. 25, 2010

(51) Int. Cl.
*G09F 1/00* (2006.01)

(52) U.S. Cl. ..... 40/124.19; 40/539; 40/124.08

(58) Field of Classification Search ..... 40/124.08, 40/124.14, 124.16, 124.19, 124.191, 538, 40/539; 446/147, 148
See application file for complete search history.

(56) References Cited

U.S. PATENT DOCUMENTS 792,130 A * 6/1905 Heftier ..... 446/148
895,771 A * 8/1908 Lackner ..... 446/148
959,655 A * 5/1910 Tuck ..... 446/87
2,148,279 A * 2/1939 Sandberg ..... 40/124.08
2,205,262 A * 6/1940 Hayes ..... 40/124.16
2,415,501 A * 2/1947 Klein et al. ..... 40/124.16
4,062,138 A * 12/1977 Warenback ..... 40/124.16
4,161,833 A * 7/1979 Wagner ..... 40/539
5,758,438 A * 6/1998 Crowell ..... 40/124.08
5,817,378 A * 10/1998 Otani ..... 428/12
6,261,658 B1 * 7/2001 Schmidt ..... 428/40.1
6,481,125 B1 * 11/2002 Pokrasoff ..... 40/124.01
2003/0097773 A1 * 5/2003 Oh ..... 40/124.08

* cited by examiner

*Primary Examiner* — Joanne Silbermann
*Assistant Examiner* — Christopher E Veraa
(74) *Attorney, Agent, or Firm* — Trop, Pruner & Hu, P.C.

(57) ABSTRACT

A postcard includes: a front postcard panel having first and second surfaces, the first surface having a stamp, address, and message-writing regions; and a rear postcard panel attached to the second surface of the front postcard panel and including at least one stand cutout that is releasably adhered to the second surface of the front postcard panel and that is detachable from the remainder of the rear postcard panel and the second surface of the front postcard panel.

7 Claims, 5 Drawing Sheets

POSTCARD

BACKGROUND OF THE INVENTION

1. Field of the Invention

The invention relates to a postcard, more particularly to a postcard having a front postcard panel and a rear postcard panel releasably adhered to the front postcard panel.

2. Description of the Related Art

Taiwan Utility Model No. M310124 discloses a postcard that has a printed pattern and a foldable portion. The foldable portion can be folded so that the printed pattern is formed into a 3D (three-dimensional) structure.

SUMMARY OF THE INVENTION

An object of the present invention is to provide a postcard that is attractive and that has a stand cutout that may be formed into a 3D structure.

According to the present invention, there is provided a postcard that comprises: a front postcard panel having first and second surfaces, the first surface having a stamp region, an address region, and a message-writing region; and a rear postcard panel attached to the second surface of the front postcard panel and including at least one stand cutout that is releasably adhered to the second surface of the front postcard panel and that is detachable from the remainder of the rear postcard panel and the second surface of the front postcard panel.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
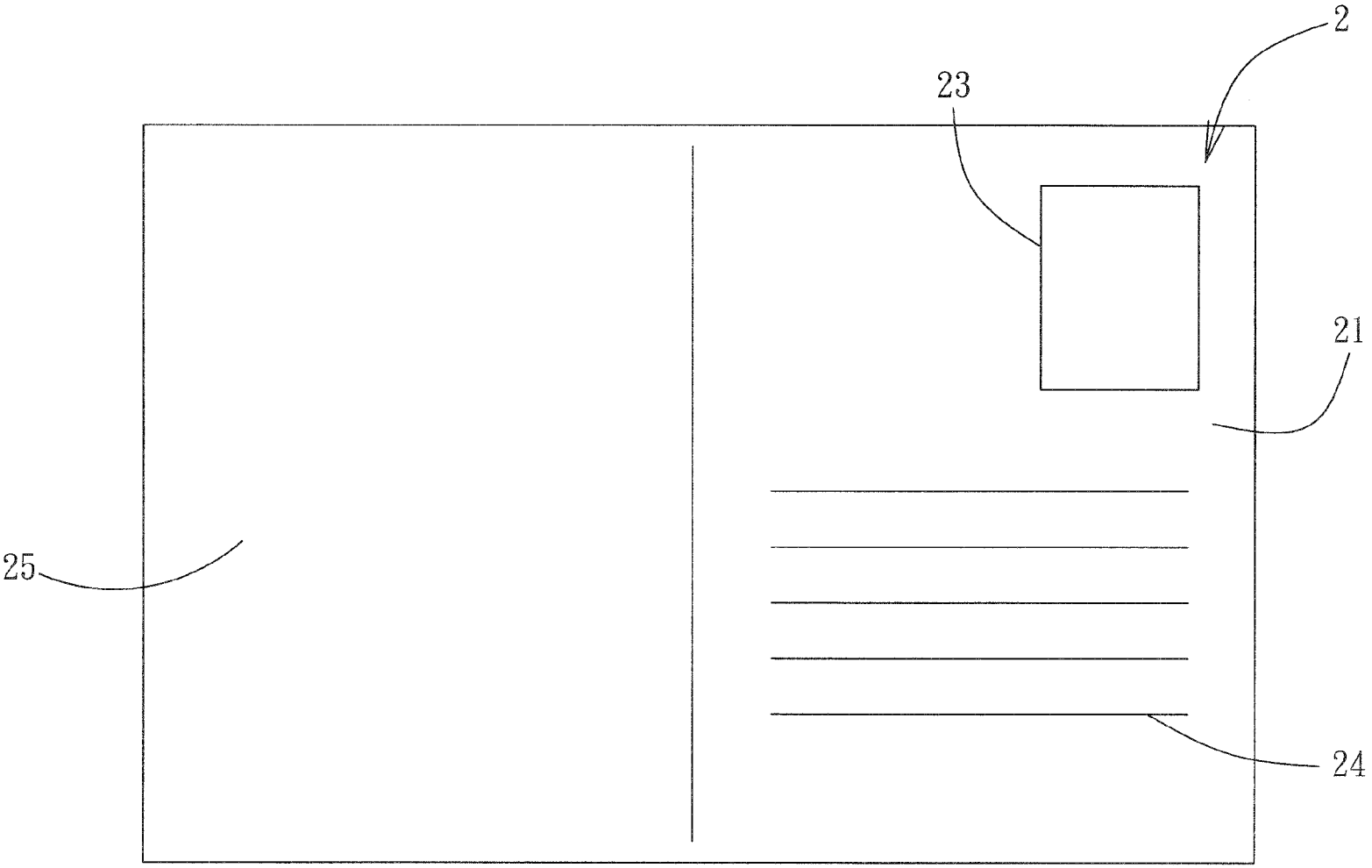
FIG. 1 is a schematic front view of the preferred embodiment of a postcard according to the present invention.
Figure 2:
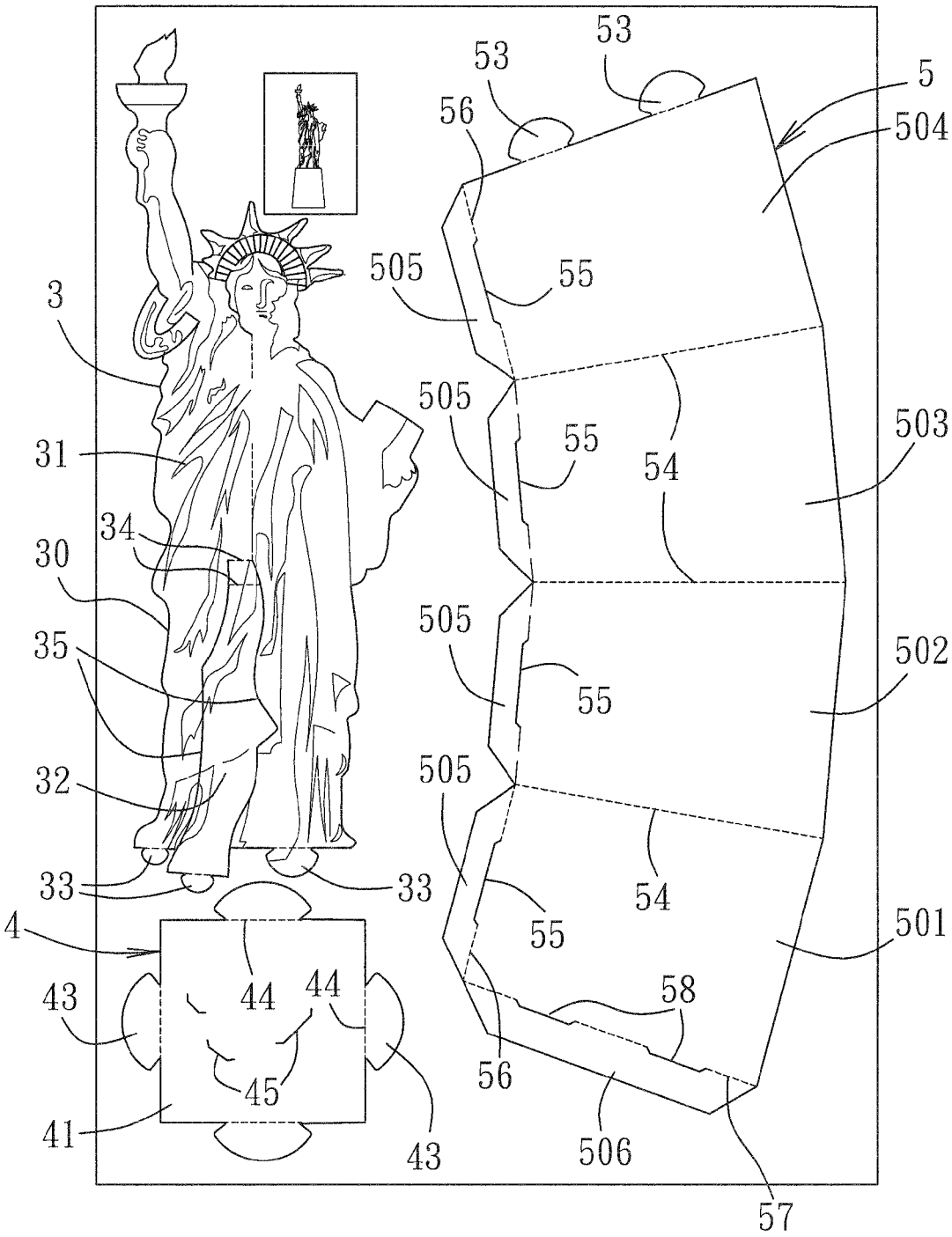
FIG. 2 is a schematic rear view of the preferred embodiment.
Figure 3:
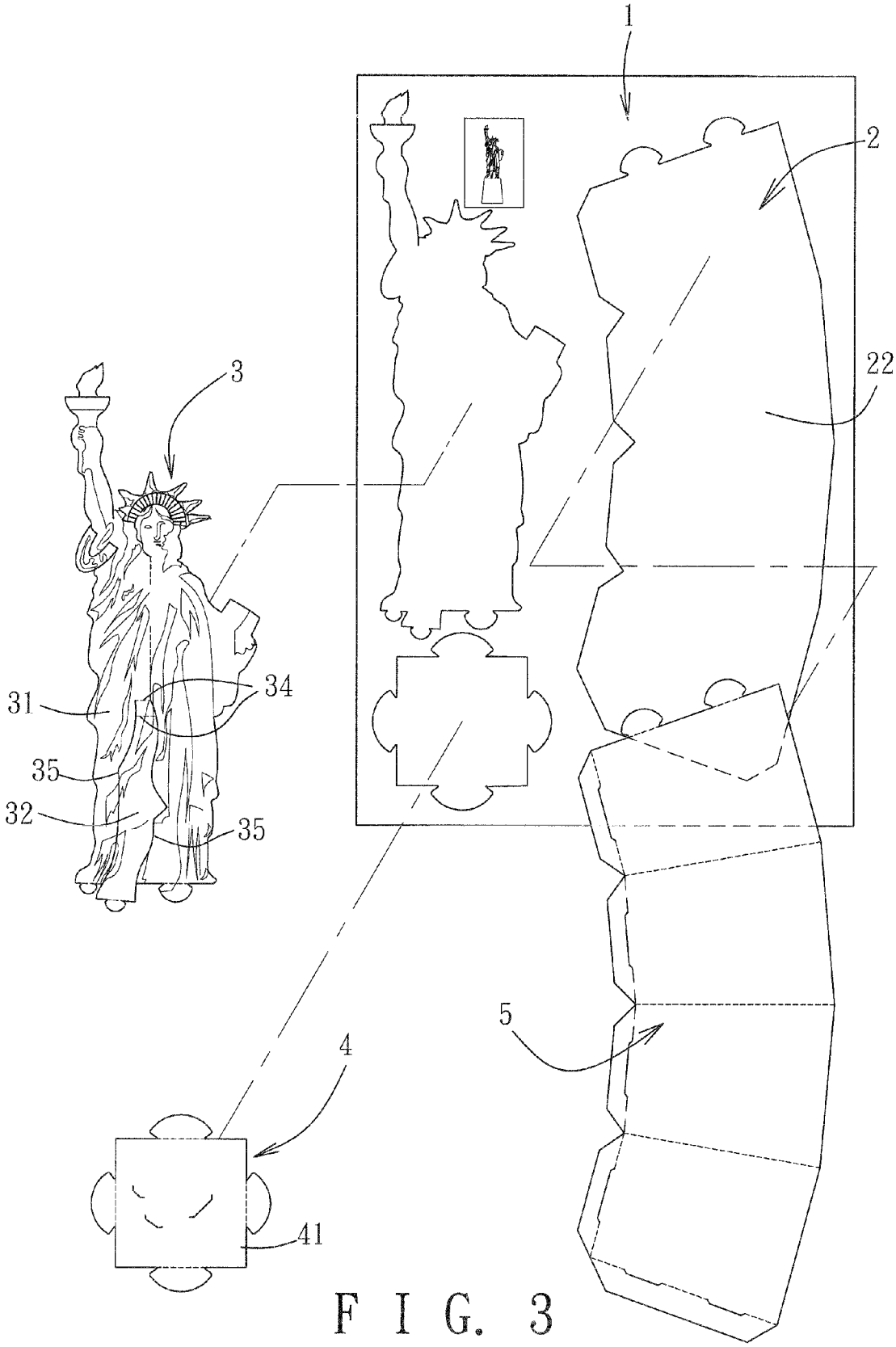
FIG. 3 is a schematic view to illustrate how stand cutouts of a rear postcard panel are detached from a front postcard panel of the preferred embodiment.

Referring to FIGS. 1 to 5, the preferred embodiment of a postcard according to the present invention is shown to include: a front postcard panel 2 having opposite first and second surfaces 21, 22, the first surface 21 having a stamp region 23, an address region 24, and a message-writing region 25; and a rear postcard panel 1 attached to the second surface 22 of the front postcard panel 2 and including first, second and third stand cutouts 3, 4, 5 that are releasably adhered to the second surface 22 of the front postcard panel 2 and that are detachable from the remainder of the rear postcard panel 1 and the second surface 22 of the front postcard panel 2.

Figure 4:
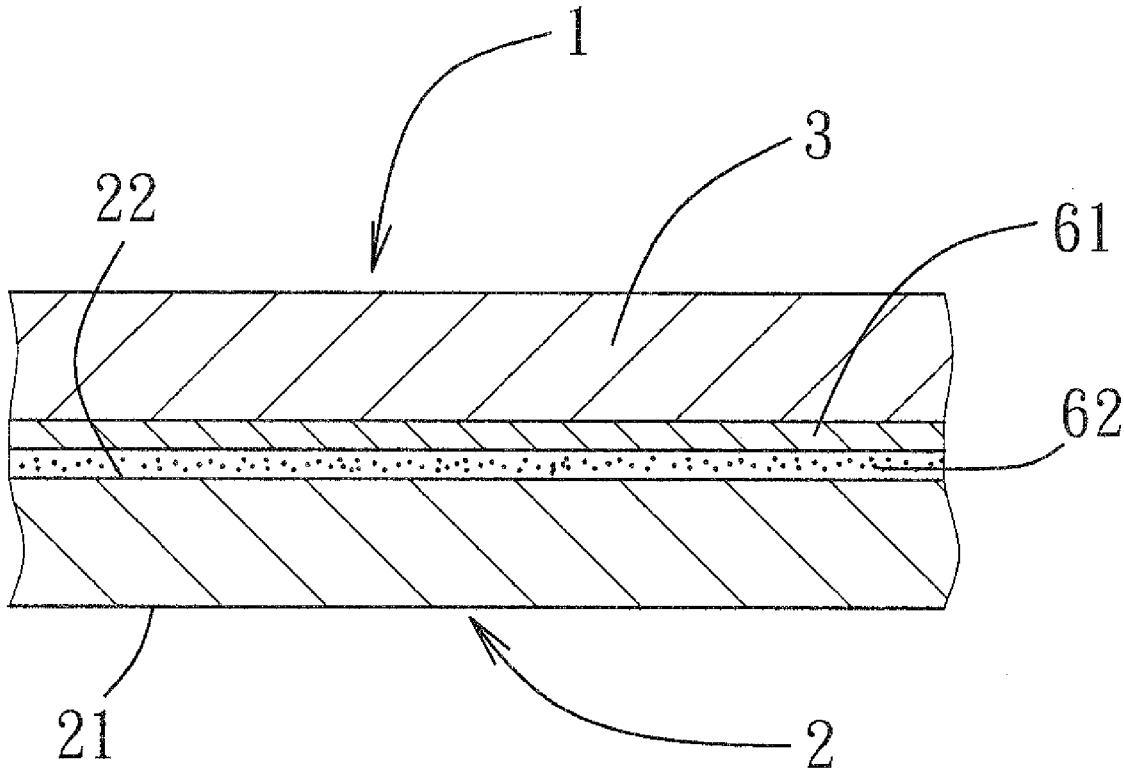
FIG. 4 is a fragmentary sectional view to illustrate a layered structure of the preferred embodiment.
Figure 5:
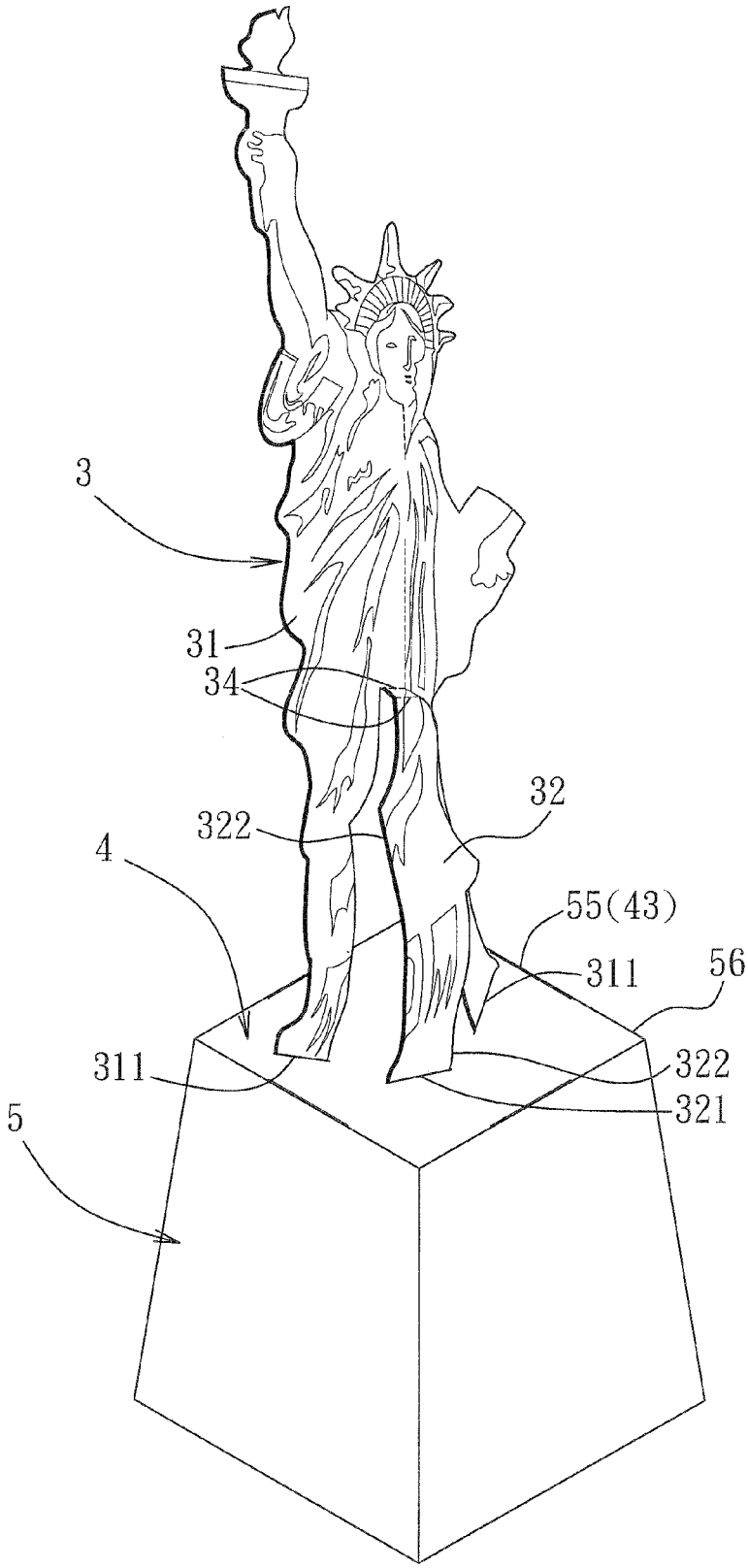
FIG. 5 is an assembled perspective view to illustrate how the stand cutouts are assembled into a decorative object.

In this embodiment, each of the first, second and third stand cutouts 3, 4, 5 is provided with a smooth layer 61 of a release material (only the smooth layer 61 of the release material of the first stand cutout 3 is shown in FIG. 4 for the sake of brevity). The second surface 22 of the front postcard panel 2 is provided with an adhesive 62 bonded to the smooth layer 61 of the release material on each of the first, second and third stand cutouts 3, 4, 5. The release material is preferably silicone.

In this embodiment, the first stand cutout 3 is formed into a particular pattern, and has a boundary 30, two fold lines 34 disposed within the boundary 30, two tear lines 35 extending respectively from two opposite ends of one of the fold lines 34 to the boundary 30 of the first stand cutout 3, and first and second portions 31, 32 divided by said one of the fold lines 34 and the tear lines 35. The first stand cutout 3 is foldable along the fold lines 34 when the stand cutout 3 is torn along the tear lines 35 so as to permit the first and second portions 31, 32 of the first stand cutout 3 to be disposed on different planes (see FIG. 5).

The first portion 31 of the stand cutout 3 has two lower ends 311. The second portion 32 of the stand cutout 3 has a lower end 321 and two opposite sides 322. The two opposite sides 322 of the second portion 32 are separated from the first portion 31 along the tear lines 35 when the stand cutout 3 is torn along the tear lines 35. The lower end 321 of the second portion 32 of the first stand cutout 3 is substantially coplanar with the lower ends 311 of the first portion 31, and the first stand cutout 3 is configured to have a decorative 3D patterned structure when the first stand cutout 3 is torn along the tear lines 35 and when the first stand cutout 3 is folded along the fold lines 34. Each of the ends 311, 321 of the first and second portions 31, 32 of the first stand cutout 3 has an insert tab 33 protruding therefrom.

The second stand cutout 4 has a rectangular base portion 41, four insert tabs 43 protruding respectively from four sides of the base portion 41, four slits 45, and four fold lines 44. Each of the fold lines 44 divides the base portion 41 and a respective one of the insert tabs 43, and permits the second stand cutout 4 to be foldable therealong. Each of the slits 45 is formed in the base portion 41.

The third stand cutout 5 has first, second, third and fourth portions 501, 502, 503, 504, four first flaps 505, a second flap 506, three first fold lines 54, four second fold lines 56, a third fold line 57, four first slits 55, two second slits 58, and two insert tabs 53. Each of the first fold lines 54 divides two adjacent ones of the first, second, third and fourth portions 501, 502, 503, 504 of the third stand cutout 5. The first flaps 55 are connected to the first, second, third and fourth portions 501, 502, 503, 504 of the third stand cutout 5, respectively. Each of the second fold lines 56 divides a respective one of the first, second, third and fourth portions 501, 502, 503, 504 of the third stand cutout 5 and a respective one of the first flaps 505. The second flap 506 is connected to the first portion 501 of the third stand cutout 5. The third fold line 57 divides the second flap 506 and the first portion 501 of the third stand cutout 5. Each of the first slits 55 extends along a respective one of the second fold lines 56. The second slits 58 extend along different sections of the third fold line 57, respectively. The insert tabs 53 protrude from the fourth portion 504 of the third stand cutout 5, and extend respectively through the second slits 58 when the third stand cutout 5 is folded along the first, second and third fold lines 54, 56, 57 so as to form the third stand cutout 5 into a 3D stand structure (see FIG. 5).

In assembly, the third stand cutout 5 is first formed into the 3D stand structure, the second stand cutout 4 is then folded along the fold lines 44, and the insert tabs 43 of the second stand cutout 4 are subsequently extended through the first slits 55 in the third stand cutout 5, respectively, so as to form the second stand cutout 4 into a platform on the 3D stand structure. The 3D patterned structure of the first stand cutout 3 is then mounted to the platform of the second stand cutout 4 by extending the insert tabs 33 of the first stand cutout 3 through the slits 45 in the second stand cutout 4, respectively.

With the inclusion of at least one of the first, second and third stand cutouts 3, 4, 5 in the postcard of this invention, the postcard can be separated into a front postcard panel 2 and a decorative 3D patterned structure. This allows the front postcard panel 2 to be left intact, and makes the postcard more attractive.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A postcard comprising:

a front postcard panel having first and second surfaces, said first surface having a stamp region, an address region, and a message-writing region; and a rear postcard panel attached to said second surface of said front postcard panel and including first, second and third stand cutouts that are releasably adhered to said second surface of said front postcard panel and that are detachable from the remainder of said rear postcard panel and said second surface of said front postcard panel;

said first stand cutout including a boundary, first and second portions bounded by said boundary, a fold line disposed within said boundary, and two tear lines extending respectively from two opposite ends of said fold line and meeting said boundary, said second portion having a lower end, said first portion having two lower ends on two sides of said lower end of said second portion, said second portion being separable partially from said first portion along said tear lines and being foldable along said fold line to move said lower end of said second portion to a plane different from a plane of said lower ends of said first portion, said lower ends of said first and second portions being free ends that have insert tabs, respectively;

said third stand cutout having a plurality of first fold lines, and a plurality of portions, which are foldable from each other along said first fold lines, each of said portions having one end that is formed with a second fold line transverse to said first fold line, a first flap foldable along said second fold line, and a first slit that is formed along said second fold line, one of said portions having an insert tab, another one of said portions having a second slit, the rest of said portions being disposed serially between said one and said another one of said portions, said insert tab of said one of said portions being interlockable with said second slit of said another one of said portions to form a three-dimensional stand structure when said portions are folded and oriented annularly;

said second stand cutout including a base portion that has multiple sides, multiple insert tabs protruding respectively from said sides of said base portion, multiple fold lines formed respectively along said multiple sides, and multiple slits respectively formed along said fold lines of said base portion, said insert tabs of said second stand cutout being foldable along said multiple fold lines, respectively;

said base portion forming a platform on top of said three-dimensional stand structure of said third stand cutout when said insert tabs of said base portion are folded along respective said fold lines of said base portion, and interlocked with said first slits of said third stand cutout, respectively;

said multiple slits of said base portion being interlockable with said insert tabs of said lower ends of said first and second portions of said first stand cutout, respectively, to erect said first stand cutout on said base portion.

2. The postcard of claim 1, wherein said stand cutout are provided with a smooth layer of a release material, said second surface of said front postcard panel being provided with an adhesive bonded to said smooth layer of said release material on said stand cutouts.

3. The postcard of claim 1, wherein said multiple slits in said base portion of said second stand cutout extend respectively along multiple lines, which are staggered relative to each other such that said lower ends of said first and second portions of said first stand cutout lie in non-coplanar different planes, respectively, after being interlocked with said multiple slits.

4. A postcard comprising:

a front postcard panel having first and second surfaces, said first surface having a stamp region, an address region, and a message-writing region; and a rear postcard panel attached to said second surface of said front postcard panel and including first, second and third stand cutouts that are releasably adhered to said second surface of said front postcard panel and that are detachable from the remainder of said rear postcard panel and said second surface of said front postcard panel;

said first stand cutout including a boundary, first and second portions bounded by said boundary, a fold line disposed within said boundary, and two tear lines extending respectively from two opposite ends of said fold line and meeting said boundary, said second portion having a lower end, said first portion having two lower ends on two sides of said lower end of said second portion, said second portion being separable partially from said first portion along said tear lines and being foldable along said fold line to move said lower end of said second portion to a plane different from a plane of said lower ends of said first portion, said lower ends of said first and second portions being free ends that have insert tabs, respectively;

said third stand cutout having a plurality of portions that are foldable from each other to be oriented annularly, said second stand cutout having multiple sides respectively interlockable with said portions of said third stand cutout to form a platform on top of said third stand cutout that has been folded, said second stand cutout further having multiple slits respectively interlockable with said insert tabs of said first and second portions of said first stand cutout to erect said first stand cutout on said second stand cutout.

5. The postcard of claim 4, wherein said multiple slits in said base portion of said second stand cutout extend respectively along multiple lines, which are staggered relative to each other such that said lower ends of said first and second portions of said first stand cutout lie in non-coplanar different planes, respectively, after being interlocked with said multiple slits.

6. A postcard comprising:

a front postcard panel having first and second surfaces, said first surface having a stamp region, an address region, and a message-writing region; and a rear postcard panel attached to said second surface of said front postcard panel and including first, second and third stand cutouts that are releasably adhered to said second surface of said front postcard panel and that are detachable from the remainder of said rear postcard panel and said second surface of said front postcard panel;

said first stand cutout having a contour of a statue, first and second portions bounded by said boundary, a fold line disposed within said boundary, and two tear lines extending respectively from two opposite ends of said fold line and meeting said boundary, said second portion having a lower end, said first portion having two lower ends on two sides of said lower end of said second portion, said second portion being separable partially from said first portion along said tear lines and being foldable along said fold line to move said lower end of said second portion to a plane different from a plane of said lower ends of said first portion, said lower ends of said first and second portions being free ends that have insert tabs, respectively;

said second and third stand cutouts being foldable and interlockable with each other to form a pedestal for erecting said statue thereon;

said second stand cutout including a two-dimensional base portion that has multiple slits formed in said base portion and respectively interlockable with said insert tabs of said lower ends of said first and second portions;

said third stand cutout having a plurality of portions which are foldable from each other to be oriented annularly, each of said portions having one end interlockable with said base portion of said second stand cutout such that said base portion of said second stand cutout forms a platform on said portions of said third stand cutout that have been folded and oriented annularly.

7. The postcard of claim 6, wherein said multiple slits in said base portion of said second stand cutout extend respectively along multiple lines, which are staggered relative to each other such that said lower ends of said first and second portions of said first stand cutout lie in non-coplanar different planes, respectively, after being interlocked with said multiple slits.

* * * * *